US010875607B2

(12) United States Patent
Hardee

(10) Patent No.: US 10,875,607 B2
(45) Date of Patent: Dec. 29, 2020

(54) INFLATABLE RAFT

(71) Applicant: WadeWater Enterprises, LLC, Jacksonville, FL (US)

(72) Inventor: Timothy Hardee, Acworth, GA (US)

( * ) Notice: Subject to any disclaimer, the term of this patent is extended or adjusted under 35 U.S.C. 154(b) by 0 days.

(21) Appl. No.: 16/414,813

(22) Filed: May 17, 2019

(65) Prior Publication Data

US 2019/0351975 A1 Nov. 21, 2019

Related U.S. Application Data

(60) Provisional application No. 62/674,437, filed on May 21, 2018.

(51) Int. Cl.
*B63B 7/00* (2020.01)
*B63B 7/08* (2020.01)

(52) U.S. Cl.
CPC ..... *B63B 7/082* (2013.01); *B63B 7/085* (2013.01); *B63B 7/087* (2013.01); *B63B 2007/006* (2013.01)

(58) Field of Classification Search
CPC ..... B63B 7/082; B63B 7/085; B63B 7/087; B63B 2007/006; B63B 7/00
USPC ..... 441/129, 131, 132; 114/345
See application file for complete search history.

(56) References Cited

U.S. PATENT DOCUMENTS

| | | | | |
|---|---|---|---|---|
| 1,392,533 | A * | 10/1921 | Smyth | B63B 7/082 114/345 |
| D116,359 | S * | 8/1939 | Banks et al. | D21/809 |
| 2,390,199 | A | 12/1945 | Walsh | |
| 3,155,992 | A | 11/1964 | Shewmake et al. | |
| 5,397,258 | A | 3/1995 | Switlik et al. | |
| 6,343,562 | B1 | 2/2002 | Ingram | |
| 8,025,541 | B2 | 9/2011 | Churchill et al. | |
| 2001/0046820 | A1 | 11/2001 | Vancil | |
| 2003/0068940 | A1* | 4/2003 | Arias | B63C 9/08 441/131 |
| 2016/0096598 | A1* | 4/2016 | Harkrider | B63B 7/08 441/130 |

* cited by examiner

*Primary Examiner* — Stephen P Avila
(74) *Attorney, Agent, or Firm* — Asgaard Patent Services, LLC; F. Wayne Thompson, Jr.

(57) ABSTRACT

Implementations of an inflatable raft that has a figure-eight shape are provided. The figure-eight shape serves to stabilize the inflatable raft and allows it to be paddled and maneuvered by a single paddler. An example inflatable raft may include a figure-eight shaped buoyant member comprised of a plurality of tube-sections. The plurality of tube-sections are connected together end-to-end to form a front lobe, a rear lobe, and a narrow central section, the narrow central section connects the front lobe to the rear lobe. The inflatable raft also includes a floor that is connected to the underside of the figure-eight shaped buoyant member. The plurality of tube sections that form the front lobe, the rear lobe, and the narrow central section are positioned to define a compartment of some depth between them, the floor acts as a bottom for the compartment.

19 Claims, 6 Drawing Sheets

INFLATABLE RAFT

CROSS REFERENCE TO RELATED APPLICATION

This application claims the benefit of U.S. Provisional Application Ser. No. 62/674,437, which was filed on May 21, 2018, the entirety of which is incorporated herein by reference.

TECHNICAL FIELD

This disclosure relates to implementations of an inflatable raft. In particular, the present disclosure is directed to implementations of an inflatable raft that have a figure-eight shape in plan view.

BACKGROUND

An inflatable raft is a lightweight water craft constructed with sides, bow, and stern made of flexible tubes containing pressurized gas (e.g., air). Frequently, inflatable rafts are constructed with parallel sides, or with sides that taper along their length. Often a transom is mounted to the stern of an inflatable raft, providing a location and structure for mounting an outboard motor.

These existing inflatable raft designs are prone to capsizing, particularly when weight is applied or shifted unevenly to one side, or when weight is placed on one side only. For example, these existing inflatable raft designs often capsize (or roll) when an occupant leans towards either side, and when climbing into or out of the raft. Therefore, increasing stability has been an objective of many prior art inflatable raft designs.

Further, existing inflatable raft designs are often too wide at their midsection for a single paddler to both propel and maneuver the craft through water using only a kayak paddle. Instead, inflatable rafts are often constructed to be propelled and maneuvered using a pair of oars. This is disadvantageous because facing forward while using oars, except on moving water, is less effective, and more strenuous on the operator, than when using a kayak paddle.

Accordingly, it can be seen that needs exist for the inflatable raft disclosed herein. It is to the provision of an inflatable raft that is configured to address these needs, and others, that the present invention is primarily directed.

OBJECTS AND SUMMARY OF THE INVENTION

An object of the present invention is to provide an inflatable raft having a figure-eight shape, in plan view, that contributes to its stability.

Another object of the present invention is to provide an inflatable raft that demonstrates a high degree of stability, without the encumbrance of auxiliary stabilization devices, such as pontoons or detachable bladders.

Yet another object of the present invention is to provide an inflatable raft that demonstrates a high degree of stability without an increased draft, such as when ballasts or keels are attached to existing inflatable rafts.

Still yet another object of the present invention is to provide an inflatable raft that can be used as a barge by one or more wading persons, such as when waterfowl hunting, for the purposes of transporting gear and serving as a relatively dry place to sit. Specifically, the figure-eight shape of the inflatable raft resists capsizing when one or more people are sitting on the side of the raft with their feet and legs in the water.

Yet another object of the present invention is to provide an inflatable raft that can be propelled and maneuvered using a single paddle, rather than using oars. The present invention narrows near its midsection, providing for the effective reach of a typical kayak paddle.

Still yet another object of the present invention is to provide an inflatable raft that allows a paddler, using a kayak paddle, to face the direction of travel.

Yet another object of the present invention is to provide an inflatable raft that demonstrates increased maneuverability in narrow environs, such as narrow creeks and flooded timber. This object of the present invention results from the inflatable raft being configured (i.e., shaped) so that a paddler can maneuver it using a kayak paddle, instead of a set of oars; the extension of the oars creates a winder foot print that limits the maneuverability of a raft in narrow environs.

Implementations of an inflatable raft are provided. The inflatable raft has a figure-eight shape, in plan view, that serves to stabilize the inflatable raft. Further, the figure-eight shape allows the inflatable raft to be paddled and maneuvered by a single paddler.

In some implementations, the inflatable raft comprises a figure-eight shaped buoyant member comprised of a plurality of tube-sections. The plurality of tube-sections are connected together end-to-end to form a front lobe, a rear lobe, and a narrow central section, the narrow central section connects the front lobe to the rear lobe. The inflatable raft further comprises a floor that is connected to the underside of the figure-eight shaped buoyant member. The plurality of tube sections that form the front lobe, the rear lobe, and the narrow central section are positioned to define a compartment of some depth between them, the floor acts as a bottom for the compartment.

In other implementations, the inflatable raft comprises a figure-eight shaped buoyant member. The figure-eight shaped buoyant member defines a front lobe that is connected to a rear lobe by a narrow central section. The inflatable raft further comprises a floor that is connected to the underside of the figure-eight shaped buoyant member; and a substantially rigid deck insert configured to rest on the floor of the inflatable raft. The substantially rigid deck insert has the general shape of a figure-eight and includes side edges that interlock with recesses formed between the floor and a bottom edge of the figure-eight shaped buoyant member, thereby securing the substantially rigid deck insert within the inflatable raft. The deck insert, when inflated, is configured to provide a substantially stable platform for a person during use of the inflatable raft, and to increase buoyancy and the overall rigidity of the inflatable raft.

BRIEF DESCRIPTION OF THE DRAWINGS

Like reference numerals refer to corresponding parts throughout the several views of the drawings.

DETAILED DESCRIPTION

Figure 1:
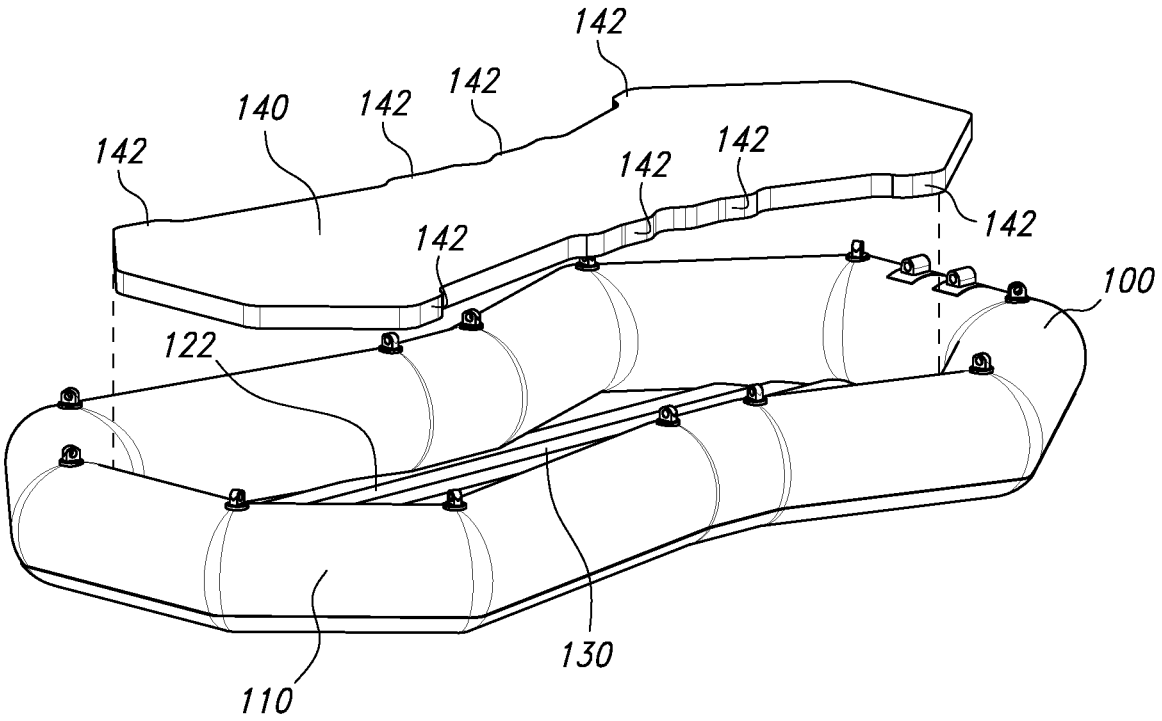
FIG. 1 is an isometric exploded view of an inflatable raft constructed in accordance with the principles of the present disclosure.

FIGS. 1-6, 9, and 12 illustrate an inflatable raft 100 constructed in accordance with the principles of the present disclosure. The inflatable raft 100 is configured to support the weight of a person, or two people sitting in tandem, on water. Alternatively, the inflatable raft 100 may be used as a barge by one or more wading persons for the purposes of transporting gear and/or as a place to sit. The inflatable raft 100 has a figure-eight shape in plan view (see, e.g., FIG. 3), the figure-eight shape serves to stabilize the inflatable raft 100. Further, the figure-eight shape allows the inflatable raft 100 to be paddled and maneuvered by a single paddler (see, e.g. FIG. 4).

As shown in FIGS. 1-6, in some implementations, the inflatable raft 100 comprises a figure-eight shaped buoyant member 110, the figure-eight shaped buoyant member 110 defines a front lobe 112 that is connected to a rear lobe 114 by a narrow central section 116. The inflatable raft 100 also comprises a floor (or deck) 130 that is connected to the underside of the figure-eight shaped buoyant member 110. In some implementations, the floor 130 may be an inflatable membrane. Alternatively, in some implementations, the inflatable raft 100 may further comprise a substantially rigid deck insert 140 configured to rest on the floor 130 and to interlock with the figure-eight shaped buoyant member 110 of the inflatable raft 100 (see, e.g., FIG. 2). The deck insert 140 is configured to provide a substantially stable platform (when inflated) for a person during use of the inflatable raft 100. Also, the deck insert 140 is configured to increase buoyancy and the overall rigidity of the inflatable raft 100.

As shown in FIGS. 1-6, the buoyant member 110 of the inflatable raft 100 is comprised of a plurality of inflatable tube-sections 118 that are connected together end-to-end to present in plan view a figure-eight outline. The tube-sections 118 of the figure-eight shaped buoyant member 110 are substantially-circular in cross section when inflated. Each tube-section 118 is made of a flexible drop-stitch material. In some implementations, one or more inflatable bladders are positioned within the figure-eight shaped buoyant member 110 of the inflatable raft 100 (not shown). Each bladder may include at least one inflation valve through which a gas, such as air, can be selectively introduced into the bladder (not shown). In this way, the tube-sections 118 of the buoyant member 110 can be inflated. Alternatively, in some implementations, the figure-eight shaped buoyant member 110 of an inflatable raft 100 may be made of foam, molded plastic(s), another sufficiently buoyant material, or combination of materials that are sufficiently buoyant.

Figure 3:
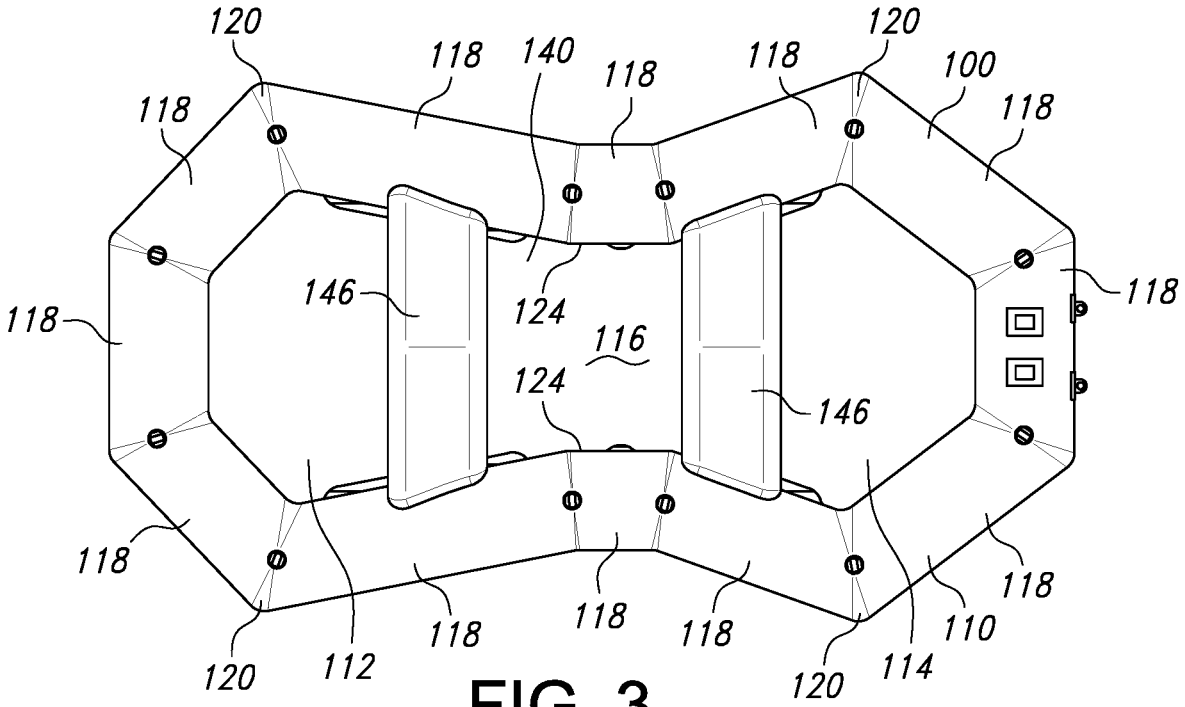
FIG. 3 is a top view of the inflatable raft shown in FIG. 2 with a second thwart positioned therein.
Figure 4:
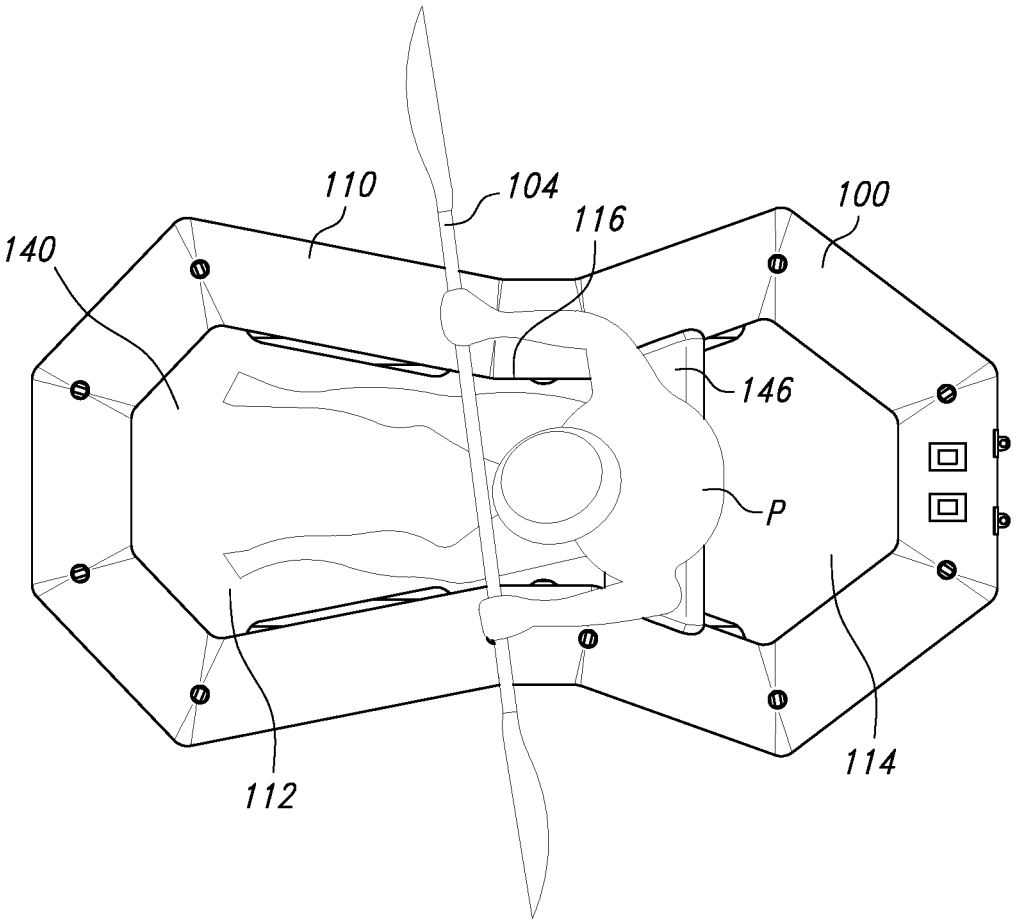
FIG. 4 is a top view of the inflatable raft shown in FIG. 2 that is in use by a person sitting on the provided thwart.
Figure 5:
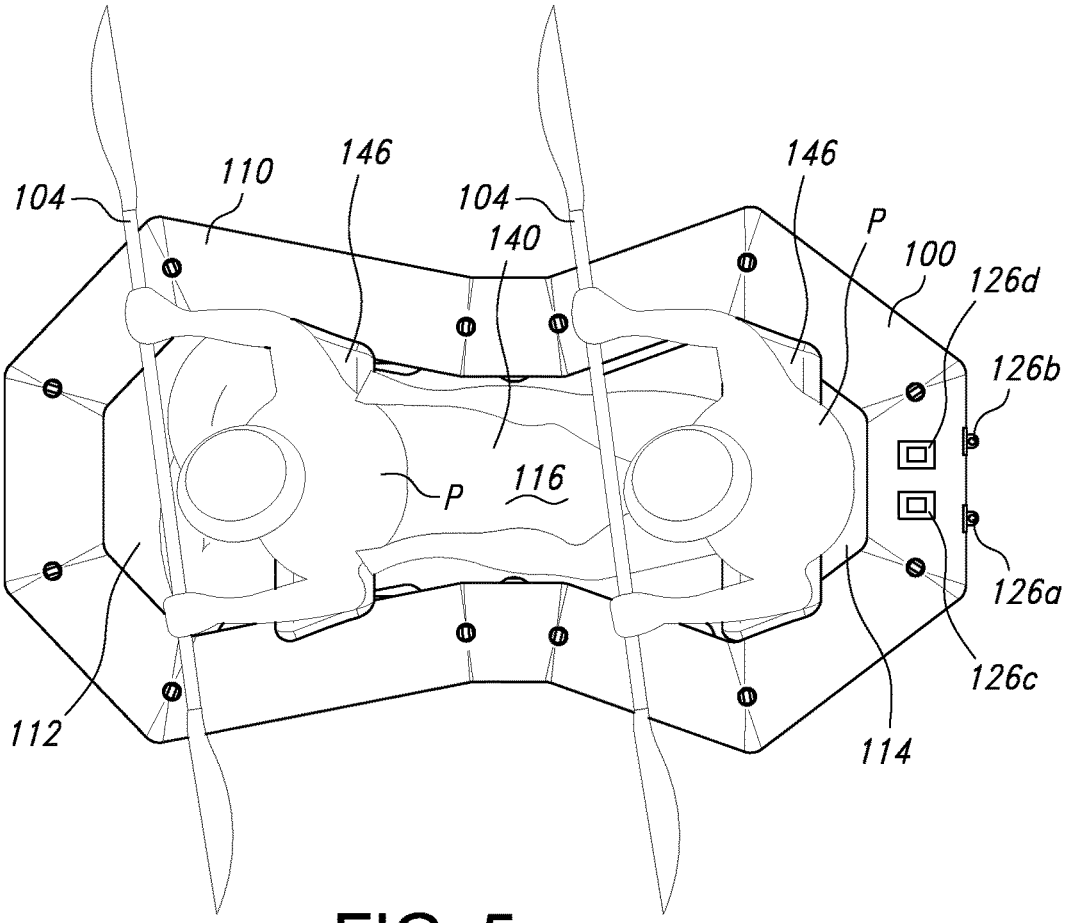
FIG. 5 is a top view of the inflatable raft shown in FIG. 3 that is in use by two people that are sitting on the provided thwarts.
Figure 6:
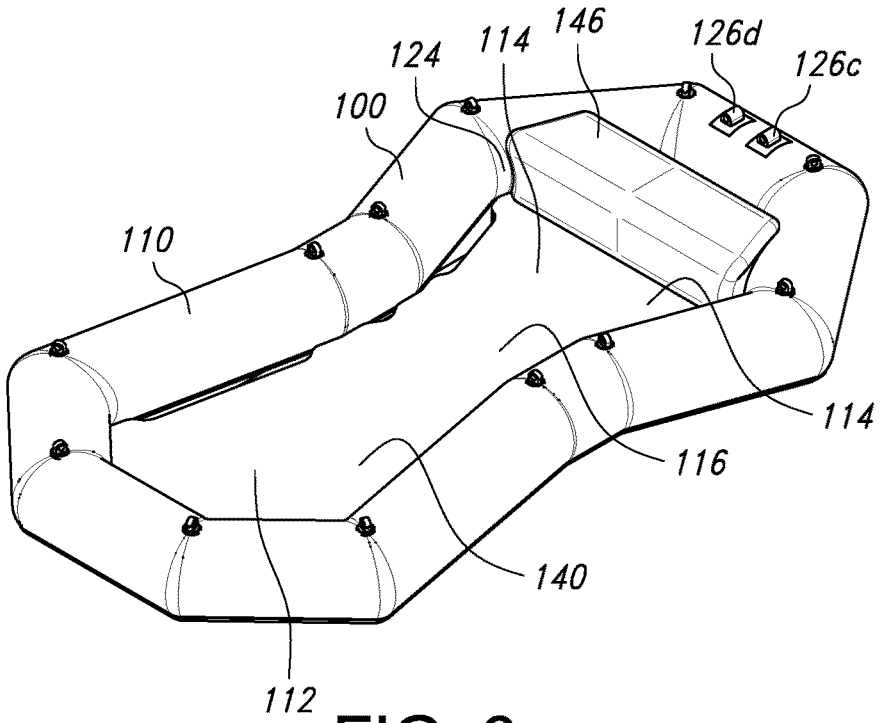
FIG. 6 is an isometric view of the inflatable raft shown in FIG. 2, wherein the thwart has been positioned adjacent the stern of the inflatable raft.

As shown best in FIGS. 3-5, advantageously, the front lobe 112 and the rear lobe 114 of the inflatable raft 100 are wider than the central section 116 thereof. The widest portions of the front and rear lobes 112, 114 act like keels, resisting the displacement of water. Therefore, in order to roll (or capsize) the inflatable raft 100, the widest portions 120 of the front and rear lobes 112, 114 must be substantially submerged, which is difficult to do, given the volume of water they displace. Also, due to the narrow central section 116 of the inflatable raft 100, the raft 100 can be paddled and maneuvered by a single paddler, using a kayak paddle 104 (see, e.g., FIGS. 4 and 5).

In some implementations, the floor 130 of the inflatable raft 100 may be one or more sheets of flexible polyvinyl chloride (PVC), chlorosulfonated polyethylene synthetic rubber (e.g., Hypalon®), or another flexible waterproof material. In this way, the underside of the floor 130 (not shown) is resistant to abrasion and better able to slide over rocks. The floor 130 is secured to the underside of the figure-eight shaped buoyant member 110 by an adhesive, stitching, or any other method known to one of ordinary skill in the art.

Figure 2:
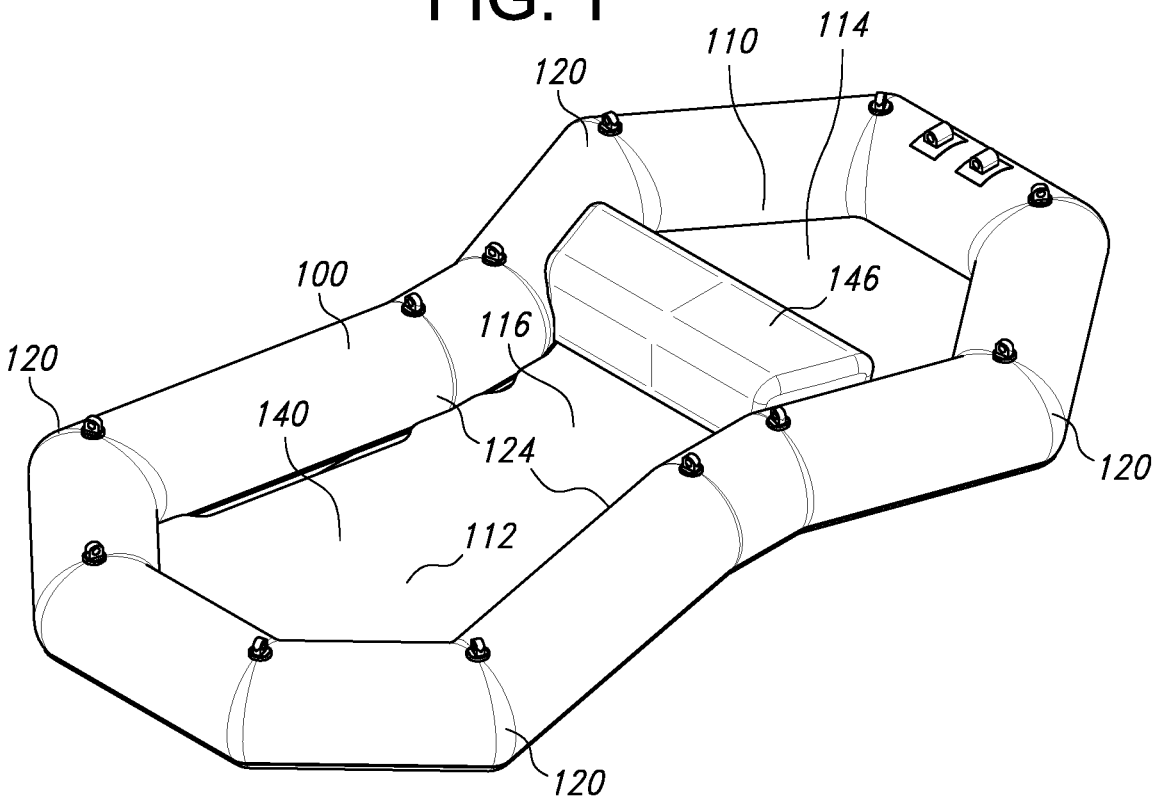
FIG. 2 is an isometric view of the inflatable raft shown in FIG. 1 with a thwart positioned therein.

As shown in FIGS. 1 and 2, the deck insert 140 is configured to fit within the recess 122 defined by the buoyant member 110 and the floor 130. In some implementations, the deck insert 140 may include sides edges 142 that interlock (when inflated) with recesses formed between the floor 130 and a bottom edge of the figure-eight shaped buoyant member 110, thereby removably securing the deck insert 140 within the inflatable raft 100. The deck insert 140 may be made of an inflatable drop-stich material, or another substantially rigid material. In some implementation, the deck insert 140 is symmetrical. In some implementations, the deck insert 140 may be held in position within the recess 122 of the inflatable raft 100 by an adhesive, mechanical fastener(s), or by any other means known to one or ordinary skill in the art.

The inflatable raft 100 may be provided in a variety of sizes. In some implementations, the overall length of the inflatable raft 100 is approximately 109 inches. But, the overall length of the inflatable raft 100 can range from 88 inches to 128 inches. In some implementations, the overall width of the front lobe 112 and the rear lobe 114 of the inflatable raft 100 is approximately 59 inches. But, the overall width of each lobe 112, 114 can range from 48 inches to 69 inches. Alternatively, in some implementations, the front lobe 112 and the rear lobe 114 may have different overall widths, but the difference between overall widths cannot exceed 8 inches. In some implementations, the narrowest width of the central section 116 of the inflatable raft 100 is 44 inches. But, the width of the central section 116 can range from 36 inches at its narrowest to 54 inches at its widest. In some implementations, the inflatable raft 100 begins to narrow at 45 inches from the front of the bow. But, the inflatable raft 110 may begin to narrow at 30 inches from either the front of the bow or the rear of the stern. In some implementations, the overall diameter of each tube-section 118 that makes up the figure-eight shaped buoyant member 110 is 11 inches. But, the overall diameter of each tube-section 118 can range from 7 inches to 17 inches.

In some implementations, the ratio of the overall width of each lobe 112, 114 to the overall length of the inflatable raft 100 is in the range of about 44% to about 63% (e.g., lobes 112, 114 having a width ranging from 48" to 69" divided by an overall length of 109"). In some implementations, the ratio of the narrowest width of the central section 116 to the overall length of the inflatable raft 100 is in the range of about 33% to about 50% (e.g., a central section 116 having a width ranging from 36" to 54" divided by an overall length of 109"). In some implementations, the ratio of the narrowest width of the central section 116 to the overall width of each lobe 112, 114 is in the range of about 65% to about 85% (e.g., a central section 116 having a width of 36" divided by a lobe 112, 114 having a width of 48"; or a central section 116 having a width of 54" divided by a lobe 112, 114 having a width of 69"). It should be understood that preserving these ratios should maintain the figure-eight shape of the inflatable raft 100.

It will be appreciated that the above dimensions (and ratios) are for example only, and that other modifications may be made to the dimensions of the inflatable raft. One of ordinary skill in the art, having the benefit of the present disclosure, could properly dimension an inflatable raft 100 to have the figure-eight shape disclosed herein.

As shown in FIGS. 2-6, in some implementations, the inflatable raft 100 may include one, or two, removable thwarts 146. In this way, a user can change the location of a thwart 146 in the inflatable raft 100. In some implementations, a thwart 146 may be used as a seat that extends athwart the inflatable raft 100. Further, in some implementations, a thwart 146 may serve as a strut configured to brace the inflatable raft crosswise. In some implementations, each thwart 146 may be contoured to rest on the deck insert 140 (or floor 130) and to interface with the interior sidewalls 124 of the buoyant member 110. In some implementations, a thwart 146 is made of an inflatable drop-stitch material. But, in other implementations, a thwart 146 could be made of any suitable material known to one of ordinary skill in the art. In some implementations, a thwart 146 may be fixed (e.g., glued) in position (not shown).

As shown in FIGS. 7-12, in some implementations, the stern of the inflatable raft 100 may be configured so that a transom 150 and/or an outboard motor bracket 160 can be secured thereon. In this way, a manually operated rudder assembly 152 or a tolling motor 162 can be attached to the inflatable raft 100.

As shown in FIGS. 7-8 and 10-12, in some implementations, the stern of the inflatable raft 100 may include four pedestals 126 thereon. An opening 128 extends through each pedestal 126*a-d* that is configured to receive therein a portion of a transom 150 and/or an outboard motor bracket 160. The pedestals 126 are arranged in pairs on the stern of the inflatable raft 100 (see, e.g., FIGS. 7 and 10). A first pair of pedestals 126*a*, 126*b* are positioned so that the openings 128 thereof are vertically oriented and a second pair of pedestals 126*c*, 126*d* are positioned so that the openings 128 thereof are horizontally oriented. Each pedestal 126*a-d* is secured to the stern of the inflatable raft 100 with an adhesive (e.g., PVC glue), but other fasteners or fastening techniques known to those of ordinary skill in the art could be used.

Figure 7:
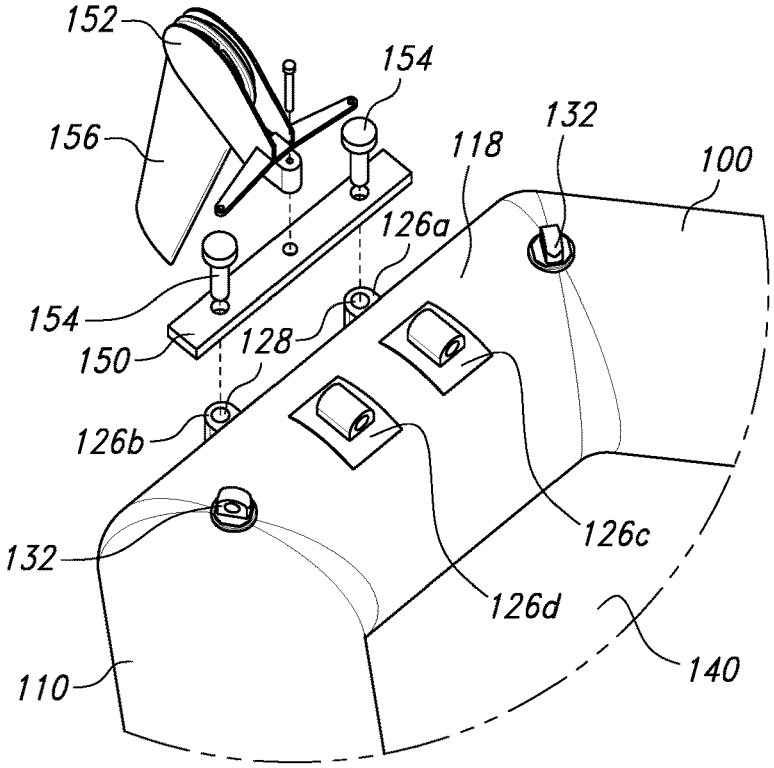
FIG. 7 is an isometric exploded view of a transom mount and a rudder assembly that can be secured to the stern of the inflatable raft shown in FIG. 1.
Figure 8:
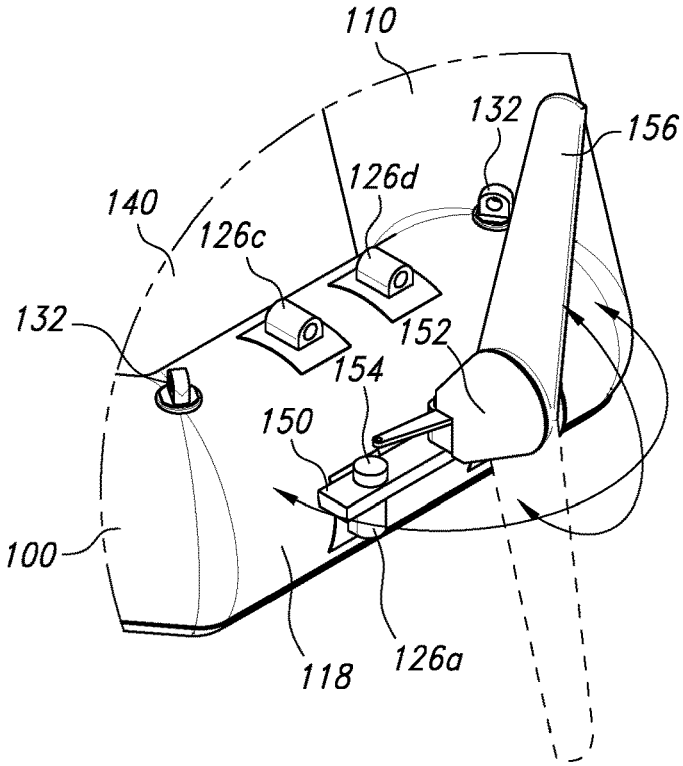
FIG. 8 is an isometric view of the rudder assembly attached to the transom mount secured to the stern of the inflatable raft shown in FIG. 1.
Figure 9:
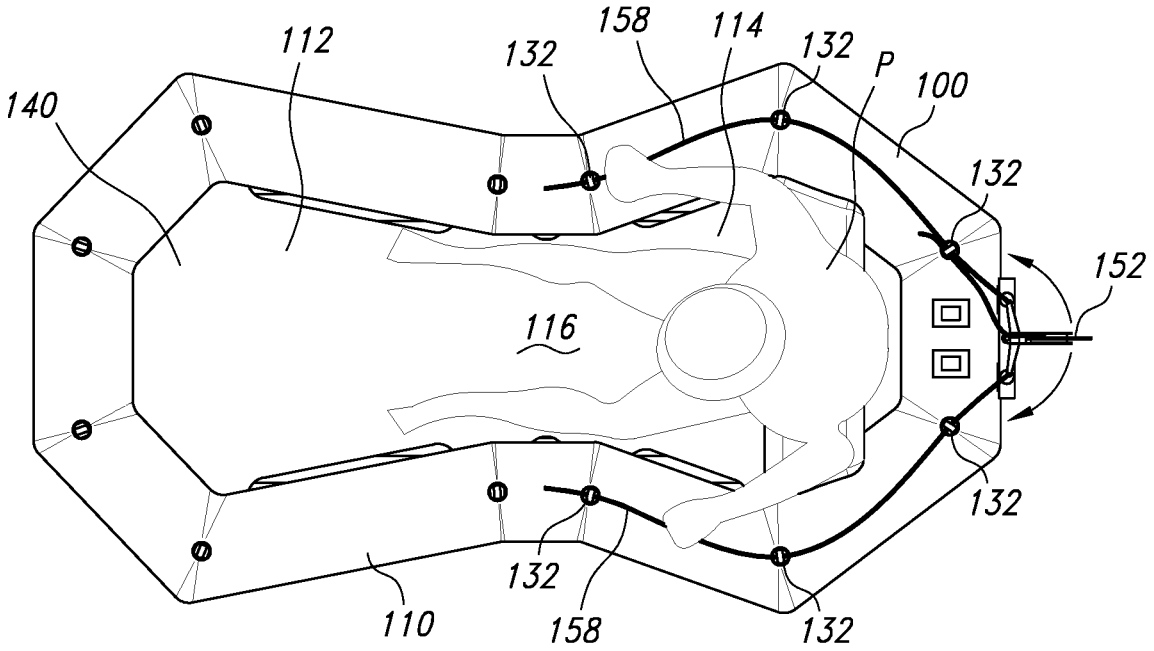
FIG. 9 is a top view of the inflatable raft shown in FIGS. 7 and 8 that is in use by a person sitting on the provided thwart.

As shown in FIGS. 7-9, in some implementations, a transom 150 can be secured to the first pair of pedestals 126*a*, 126*b* by a pair of pegs 154. In this way, a rudder assembly 152 can be secured to the transom 152 and used to maneuver the inflatable raft 100. In some implementations, the rudder 156 of the rudder assembly 152 can be lifted up when not in use (see, e.g., FIG. 8). In some implementations, the rudder assembly 152 may include two lengths of cord 158 that can be used to rotate the rudder 156 side-to-side, thereby steering the inflatable raft 100 (see, e.g., FIG. 9). In some implementations, each length of cord 158 may extend through openings in grommets 132 positioned on a top side of the figure-eight shaped buoyant member 110.

Figure 10:
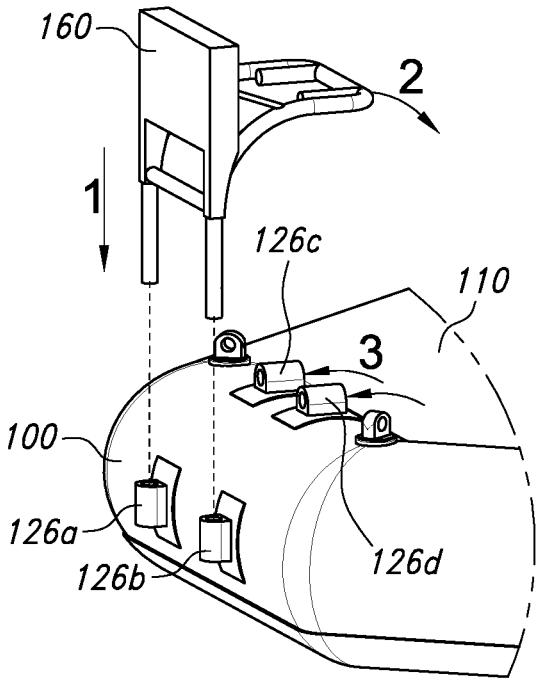
FIG. 10 is an isometric exploded view of an outboard motor bracket that can be secured to the stern of the inflatable raft shown in FIG. 1.
Figure 11:
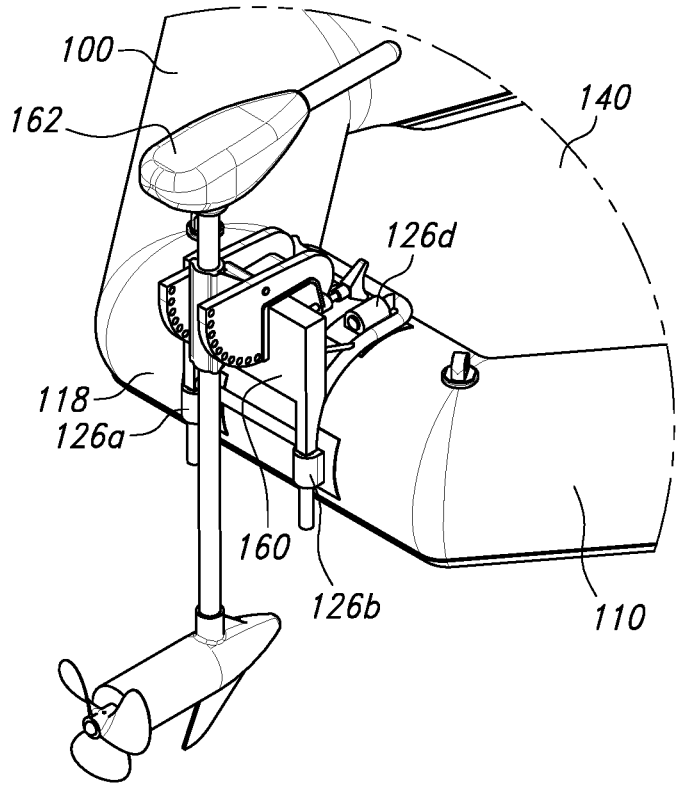
FIG. 11 is an isometric view of a trolling motor attached to the outboard motor bracket secured to the stern of the inflatable raft shown in FIG. 1.
Figure 12:
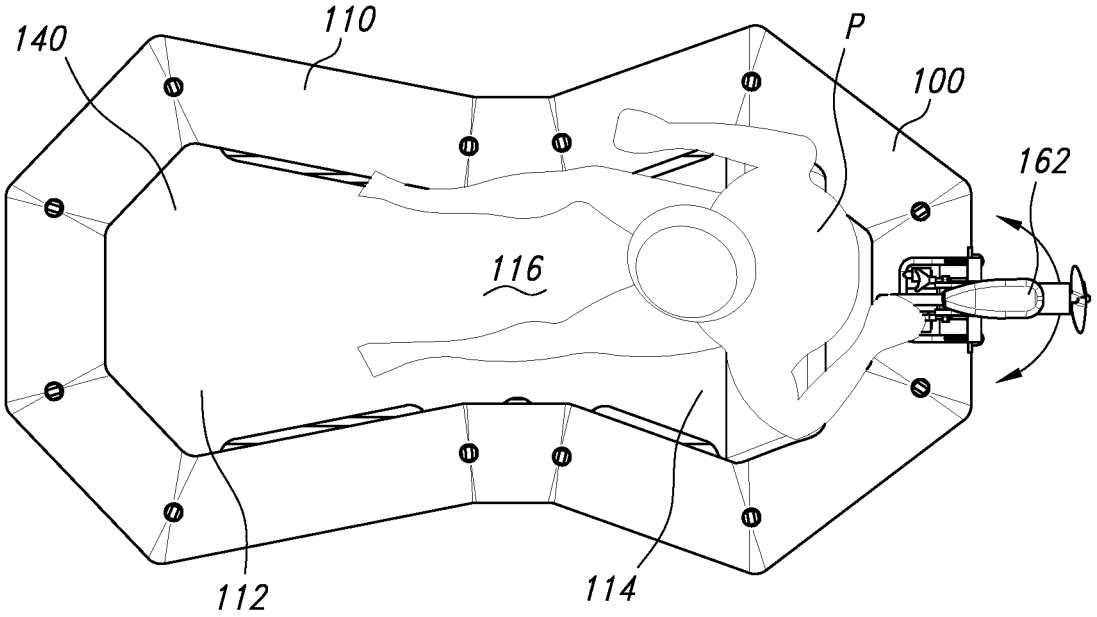
FIG. 12 is a top view of the inflatable raft shown in FIGS. 10 and 11 that is in use by a person sitting on the provided thwart.

As shown in FIGS. 9-12, in some implementations, an outboard motor bracket 160 can be secured to the stern of the inflatable raft 100 using the provided pedestals 126. In this way, a trolling motor 162 can be secured to the outboard motor bracket 160 and used to propel and maneuver the inflatable raft 100. In order, FIG. 10 shows the three steps used to secure the outboard motor bracket 160 to the pedestals 126 affixed to the stern of the inflatable raft 100.

Although not shown in provided illustrations, in some implementations, the bow and/or stern of the inflatable raft 100 could be curved up (i.e., include a kick rocker). This may be done to increase the maneuverability of the inflatable raft 100, thereby allowing it to more easily navigate waves and rapids.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An inflatable raft comprising:

a figure-eight shaped buoyant member comprised of a plurality of tube-sections, the plurality of tube-sections are connected together end-to-end to form a front lobe, a rear lobe, and a narrow central section, the narrow central section connects the front; and a floor that is connected to the underside of the figure-eight shaped buoyant member;

wherein the plurality of tube sections that form the front lobe, the rear lobe, and the narrow central section are positioned to define a compartment of some depth between them, the floor acts as a bottom for the compartment.

2. The inflatable raft of claim 1, wherein the plurality of tube-sections are inflatable.

3. The inflatable raft of claim 1, wherein the front lobe and the rear lobe of the inflatable raft are wider that the narrow central section and thereby resist the displacement of water.

4. The inflatable raft of claim 1, further comprising a substantially rigid deck insert configured to rest on the floor of the inflatable raft and to interlock with the figure-eight shaped buoyant member.

5. The inflatable raft of claim 4, wherein the substantially rigid deck insert includes side edges that interlock with recesses formed between the floor and a bottom edge of the figure-eight shaped buoyant member, thereby securing the deck insert within the inflatable raft.

6. The inflatable raft of claim 1, further comprising a thwart configured to be used as a seat, the thwart extends athwart the inflatable raft.

7. The inflatable raft of claim 6, wherein the thwart is configured to brace the inflatable raft crosswise.

8. An inflatable raft comprising:

a figure-eight shaped buoyant member, the figure-eight shaped buoyant member defines a front lobe that is connected to a rear lobe by a narrow central section;

a floor that is connected to the underside of the figure-eight shaped buoyant member; and a substantially rigid deck insert configured to rest on the floor of the inflatable raft, the substantially rigid deck insert has the general shape of a figure-eight;

wherein the substantially rigid deck insert includes side edges that interlock with recesses formed between the floor and a bottom edge of the figure-eight shaped buoyant member, thereby securing the substantially rigid deck insert within the inflatable raft.

9. The inflatable raft of claim 8, wherein the figure-eight shaped buoyant member is comprised of a plurality of inflatable tube-sections that are connected together end-to-end.

10. The inflatable raft of claim 8, wherein the front lobe and the rear lobe of the inflatable raft are wider than the narrow central section and thereby resist the displacement of water.

11. The inflatable raft of claim 8, further comprising a thwart configured to be used as a seat, the thwart extends athwart the inflatable raft.

12. The inflatable raft of claim 11, wherein the thwart is configured to brace the inflatable raft crosswise.

13. An inflatable raft comprising:

a figure-eight shaped buoyant member comprised of a plurality of tube-sections, the plurality of tube-sections are connected together end-to-end to form a front lobe, a rear lobe, and a narrow central section, the narrow central section connects the front lobe to the rear lobe; and a floor that is connected to the underside of the figure-eight shaped buoyant member;

wherein the plurality of tube sections that form the front lobe, the rear lobe, and the narrow central section are positioned to define a compartment of some depth between them, the floor acts as a bottom for the compartment;

wherein the ratio of the overall width of each lobe to the overall length of the inflatable raft is in the range of about 44% to about 63%;

wherein the ratio of the narrowest width of the central section to the overall length of the inflatable raft is in the range of about 33% to about 50%;

wherein the ratio of the narrowest width of the central section to the overall width of each lobe is in the range of about 65% to about 85%.

14. The inflatable raft of claim 13, wherein the plurality of tube-sections are inflatable.

15. The inflatable raft of claim 13, wherein the front lobe and the rear lobe of the inflatable raft are wider that the narrow central section and thereby resist the displacement of water.

16. The inflatable raft of claim 13, further comprising a substantially rigid deck insert configured to rest on the floor of the inflatable raft and to interlock with the figure-eight shaped buoyant member.

17. The inflatable raft of claim 16, wherein the substantially rigid deck insert includes side edges that interlock with recesses formed between the floor and a bottom edge of the figure-eight shaped buoyant member, thereby securing the deck insert within the inflatable raft.

18. The inflatable raft of claim 13, further comprising a thwart configured to be used as a seat, the thwart extends athwart the inflatable raft.

19. The inflatable raft of claim 18, wherein the thwart is configured to brace the inflatable raft crosswise.

* * * * *